US009930743B1

(12) United States Patent
Wang et al.

(10) Patent No.: US 9,930,743 B1
(45) Date of Patent: Mar. 27, 2018

(54) TUNABLE LED

(71) Applicant: Infineon Technologies Austria AG, Villach (AT)

(72) Inventors: Zhongfang Wang, Singapore (SG); Tiam Poh Lau, Singapore (SG)

(73) Assignee: Infineon Technologies Austria AG, Villach (AT)

( * ) Notice: Subject to any disclaimer, the term of this patent is extended or adjusted under 35 U.S.C. 154(b) by 0 days.

(21) Appl. No.: 15/354,502

(22) Filed: Nov. 17, 2016

(51) Int. Cl.
*H05B 37/02* (2006.01)
*H05B 33/08* (2006.01)

(52) U.S. Cl.
CPC ..... *H05B 33/0857* (2013.01); *H05B 33/089* (2013.01); *H05B 33/0815* (2013.01); *H05B 33/0845* (2013.01); *H05B 33/0872* (2013.01); *H05B 37/0272* (2013.01)

(58) Field of Classification Search
CPC ..... H05B 33/0815; H05B 33/0845; H05B 33/0857; H05B 33/0872; H05B 33/089
USPC ..... 315/151–152, 307, 312
See application file for complete search history.

(56) References Cited

U.S. PATENT DOCUMENTS 7,088,059 B2 * 8/2006 McKinney ..... H05B 33/0818 315/291
2008/0265793 A1 * 10/2008 Gurr ..... H05B 33/0812 315/225
2013/0134900 A1 * 5/2013 Liang ..... H05B 33/0863 315/292
2014/0312777 A1 * 10/2014 Shearer ..... H05B 33/0869 315/151
2015/0351190 A1 * 12/2015 Walters ..... H05B 33/0815 315/186
2016/0242252 A1 * 8/2016 Lim ..... H05B 33/0854

OTHER PUBLICATIONS

Garg, et al., "Embracing Tunable White LEDs as the Next Generation of Lighting," Cypress Perform, Apr. 2008, 5 pp.
Tomasovics, "LED Lighting with XMC1000," Infineon Microcontroller Training, Infineon, Feb. 7, 2014, 36 pp.
Bush, "Chip gives dim-to-warm LED lighting without MCU," Electronics Weekly, Apr. 2014, 3 pp.
"Dim to warm is the final piece of the LED puzzle (Magazine)," Nov. 15, 2013, 3 pp.
"Specifications," Sharp, Spec No. DG-145050, Model No. GW6TGBJC50C, Aug. 21, 2014, 16 pp.
Gupta, et al., "Developing a Tunable LED White Light System," electronic design, Dec. 17, 2012, 7 pp.

* cited by examiner

*Primary Examiner* — Tung X Le
(74) *Attorney, Agent, or Firm* — Shumaker & Sieffert, P.A.

(57) ABSTRACT

A device includes light source and a controller. The light source includes a first LED coupled to a second LED, where a first terminal of the first LED is coupled to a first terminal of the second LED. The controller is configured to receive an input signal indicative of a color of light. The controller is also configured to adjust, based on the input signal, a first proportion of a current, the first proportion being applied to the first LED. The controller is also configured to adjust, based on the input signal, a second proportion of the current, the second proportion being applied to the second LED.

18 Claims, 9 Drawing Sheets

500

TUNABLE LED

TECHNICAL FIELD

The disclosure relates to electrical light emitting diodes (LEDs), and in particular, to control circuits for the LEDs.

BACKGROUND

Control circuits may be used to control the amount of current flowing through loads with specific current and/or voltage requirements, such as light-emitting diodes (LEDs). A light source may include two or more LEDs that emit different colors of light. The control circuits may include multiple control signals that individually control the different LEDs in order to control the color correlated temperature (CCT) of the light emitted by the light source.

SUMMARY

In general, the techniques described in this disclosure are related to control circuitry for a light emitting diode (LED) based light source. For example, a light source may include at least two LEDs that output different colors of light. An LED driver may supply a current to the light source to control the brightness of the light emitted by the light source. A controller may control the color correlated temperature of the light source by controlling a respective proportion of the current that is applied to the each of the respective LEDs.

In one example, a device includes a light source that includes a first LED coupled to a second LED, wherein a first terminal of the first LED is coupled to a first terminal of the second LED; and a controller configured to: receive an input signal indicative of a color of light; adjust, based on the input signal, a first proportion of a current, the first proportion being applied to the first LED; and adjust, based on the input signal, a second proportion of the current, the second proportion being applied to the second LED.

In another example, a method of controlling a color correlated temperature of light emitted by a light source includes: receiving, by a controller, an input signal indicative of a color of light; adjusting, by the controller and based on the input signal, a first proportion of a current, the first proportion being applied to a first LED of the light source; and adjusting, by the controller and based on the input signal, a second proportion of the current, the second proportion being applied to a second LED of the light source, wherein a first terminal of the first LED is coupled to a first terminal of the second LED.

The details of one or more examples of the techniques of this disclosure are set forth in the accompanying drawings and the description below. Other features, objects, and advantages of the techniques will be apparent from the description and drawings, and from the claims.

DETAILED DESCRIPTION

A light emitting diode (LED) illuminates when current flows through the LED. An LED light source may include a plurality of LEDs. One or more of the plurality of LEDs may emit light associated with a color correlated temperature (CCT) that is different than the color correlated temperature of a second LED of the plurality of LEDs. A controller may generate a control signal that controls how much current of a total available current flows through each of the LEDs. By controlling the amount of current flowing through each LED at a given point in time, the controller may control the CCT of the LED light source. However, conventional techniques for controlling the CCT of the light source may require complex controllers, which may increase the complexity and cost of the LED light source.

The techniques described in this disclosure may enable a controller to control the CCT of the light emitted by the LED light source. For example, an LED driver may output a DC voltage that controls the total current applied to the light source in order to control the brightness of the light emitted by the LED light source. A controller may output a control signal that controls the proportion of the total current that is applied to a first LED and the proportion of the total current that is applied to the second LED. By controlling the proportion of the current that is applied to the respective LEDs of the LED light source, the controller may control the CCT of the light emitted by the LED light source. The described techniques may allow for a controller that includes fewer components than other controllers, which may reduce the complexity of the LED light source, the cost of the LED light source, or both.

Figure 1:
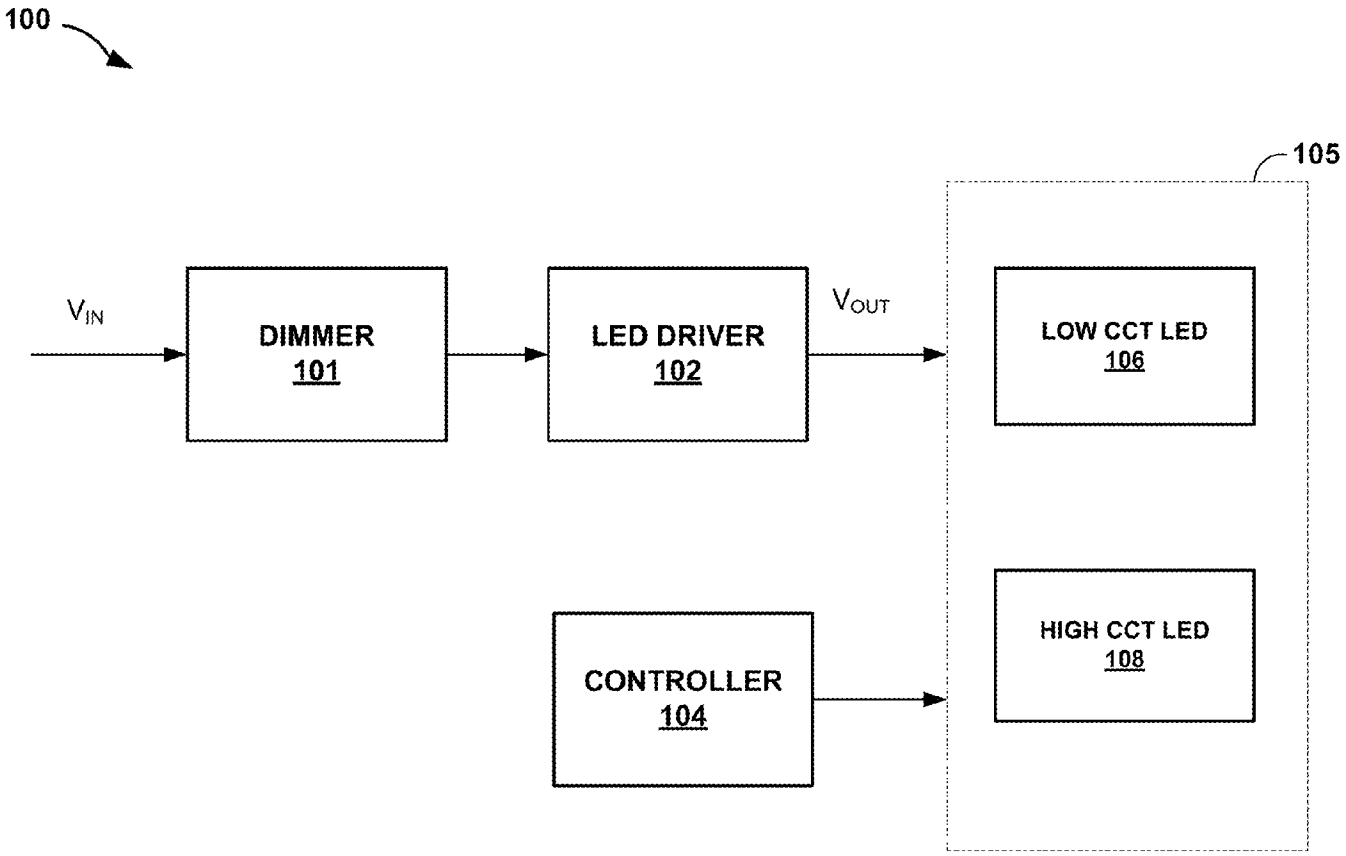
FIG. 1 is a conceptual block diagram illustrating an example of an LED lighting system, in accordance with an example of this disclosure.

FIG. 1 is a conceptual block diagram illustrating an example of an LED lighting system, in accordance with an example of this disclosure. LED lighting system 100 may include dimmer 101, LED driver 102, controller 104, and light source 105. LED lighting system 100 may include additional or fewer components. For example, system 100 may include a printed board (PB) to which components of LED lighting system 100 are electrically and mechanically coupled. In some examples, dimmer 101, LED driver 102, controller 104, and light source 105 may be individual components or may represent a combination of one or more components that provide the functionality of system 100 as described herein.

Dimmer 101 may receive an input voltage VIN from a power source. For example, dimmer 101 may include a phase-cut dimmer which may receive an alternating-current (AC) voltage, cut off part of the AC waveform, and output the remaining portion of the AC waveform to LED driver 102. In some examples, dimmer 101 may include a physical control device (e.g., a slide actuator or rotating control knob) coupled between an input voltage and LED driver 102. In some examples, dimmer 101 may include a wireless module which may receive a dimming signal via a wireless communication signal (e.g., Bluetooth).

LED driver 102 may produce a constant power or constant current to drive light source 105. The level of constant power or constant current may be determined by dimmer 101. For instance, increasing the amount of current applied to light source 105 may increase the brightness of the light emitted by light source 105. In some examples, LED driver 102 may receive an AC voltage from dimmer 101, convert the AC voltage to a DC voltage, and may output a DC voltage to light source 105. In other examples, LED driver 102 may be connected to a DC input.

Light source 105 may include a plurality of LEDs, such as Low CCT LED 106 and High CCT LED 108 (collectively, LEDs 106 and 108). LEDs 106 and 108 may illuminate or emit light when current flows through them. For example, LED driver 102 may output a direct current to light source 105, which may cause one or more of LEDs 106 and 108 to illuminate. The CCT of the light emitted by light source 105 may be based on the on CCT of the individual LEDs 106 and 108. In some examples, LEDs 106 and 108 may emit light associated with different CCTs, such that the CCT of the light emitted by light source 105 may be a mixture of the light emitted by LEDs 106 and 108. For example, Low CCT LED 106 may emit a warm white light (e.g., with a CCT between approximately 2200K and approximately 3500K) and High CCT LED 108 may emit a cool white light (e.g., with a CCT between approximately 3500K and approximately 7000K). In other examples, Low CCT LED 106 may emit an amber light (e.g., with a CCT between approximately 1800K and approximately 3300K) and High CCT LED 108 may emit a white light (e.g., with a CCT between approximately 3500K and approximately 7000K). Each LED of LEDs 106 and 108 may include a positive terminal and a negative terminal. A first terminal of Low CCT LED 106 may be coupled to a first terminal of High CCT LED 108

Low CCT LED 106 may represent a single LED or an array of LEDs. Likewise, High CCT LED 108 may represent a single LED or an array of LEDs. As illustrated in FIG. 1, light source 105 in shown with two LEDs that emit light with different CCTs. In some examples, light source 105 may include additional LEDs that emit light with a CCT that is different from the CCT of the light emitted by Low CCT LED 106 and the light emitted by High CCT LED 108.

Controller 104 may include one or more processors, including, one or more microprocessors, digital signal processors (DSPs), application specific integrated circuits (ASICs), field programmable gate arrays (FPGAs), or any other equivalent integrated or discrete logic circuitry, as well as any combinations of such components.

LED lighting system 100 may include at least one transistor. The at least one transistor may be included as part of controller 104, light source 105, or both. The at least one transistor may include a bipolar junction transistor (BJTs), a junction gate field-effect transistor (JFET), a metal-oxide-semiconductor field-effect transistors (MOSFET), an insulated gate bipolar transistor (IGBT), or other types of transistor. In some examples, a transistor may include components referred to as a gate, a source, and a drain. In other examples, a transistor may include components referred to as a base, a collector, and an emitter.

Controller 104 may receive an input signal (e.g., via a physical control device such as a slide actuator or a rotating control knob) indicating a desired color of light. For instance, a user may adjust the physical control device to indicate that light source 105 should emit a warmer light or a cooler light. Controller 104 may receive the input signal indicative of the desired color of light and may output, based on the input signal, a control signal to control the CCT of the light emitted by light source 105. The control signal from controller 104 may control the respective proportion of the current supplied by LED driver 102 that is applied to Low CCT LED 106 and High CCT LED 108. For example, controller 104 may include circuitry which may output a control signal to a transistor. The control signal may cause the transistor to turn on or turn off, which may change the proportion of the current that is applied to Low CCT LED 106 and the proportion of the current that is applied to High CCT LED 108. For example, the transistor may be coupled in series to a second terminal of Low CCT LED 106. By turning the transistor on, controller 104 may cause at least some of the current supplied by LED driver 102 to flow from LED driver 102 through the transistor and Low CCT LED 106, which may affect the proportion of the current supplied by LED driver 102 that is applied to Low CCT LED 106 and the proportion of the current that is applied to High CCT LED 108. In some examples, controller 104 may adjust the color of the light emitted by light source 105 by adjusting the proportion of the current applied to Low CCT LED 106 and the proportion of the current applied to High CCT LED 108.

The techniques described in this disclosure may improve or simplify the control of a light source. By applying the control signal to a transistor, a controller may adjust the proportion of the current supplied by an LED driver that is applied to LEDs that emit light with different CCTs. By adjusting the proportion of the current that is applied to the different LEDs of the LED light source, the controller may enable an LED light source emit light associated with various CCTs. The controller may utilize a single control signal in order to adjust the CCT of the light emitted by the light source. By utilizing a single control signal, the logic and/or structure of the controller may be reduced, which may reduce the cost and/or complexity of the controller.

Figure 2:
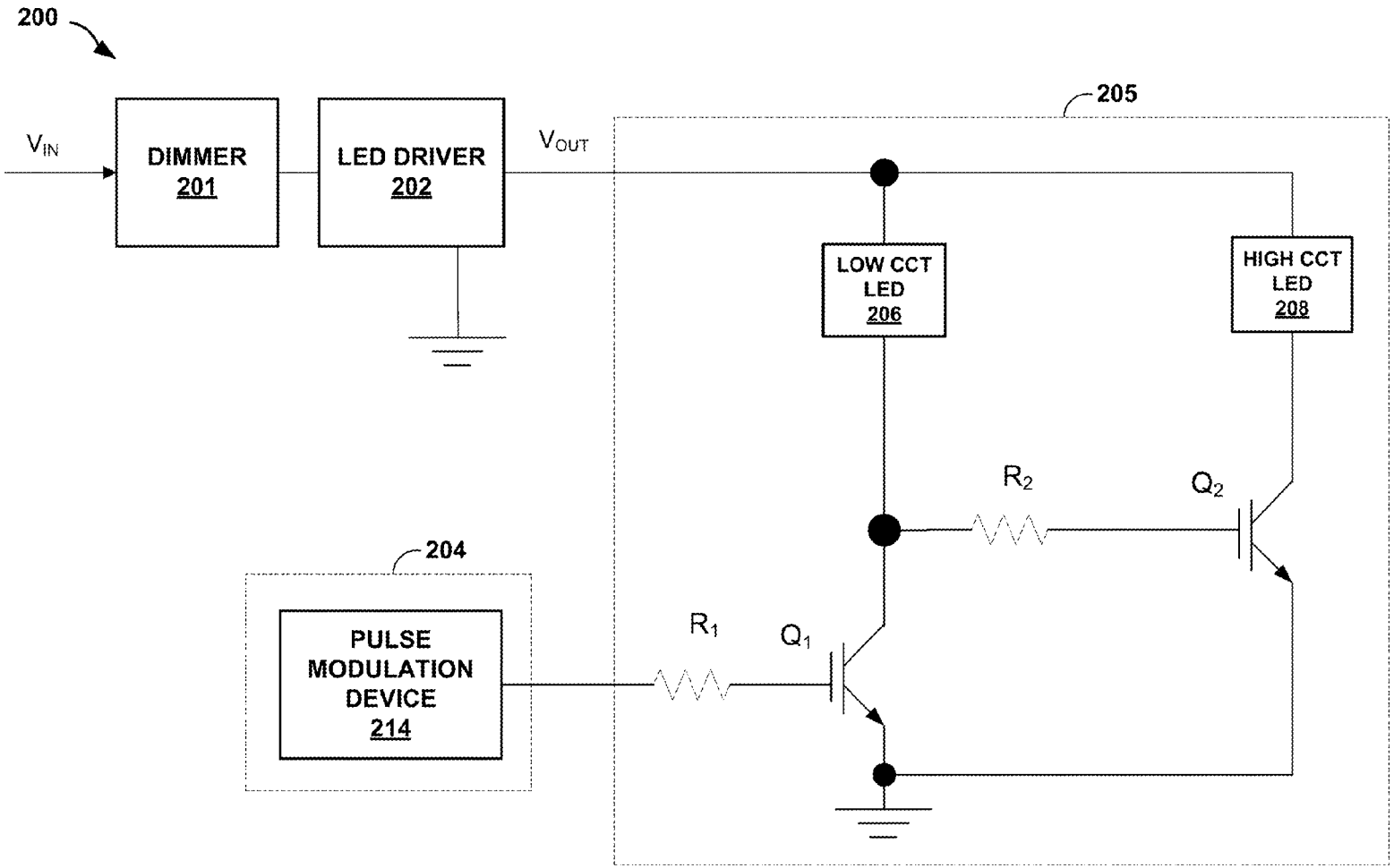
FIG. 2 is a circuit diagram illustrating an example LED lighting system, in accordance with an example of this disclosure.

FIG. 2 is a circuit diagram illustrating an example LED lighting system, in accordance with an example of this disclosure. LED lighting system 200 may be an example of LED lighting system 100 of FIG. 1. As illustrated in FIG. 2, LED lighting system 200 may include dimmer 201, LED driver 202, controller 204, and light source 205.

Dimmer 201 and LED driver 202 may be examples of dimmer 101 and LED driver 202 of FIG. 1, respectively. In some examples, dimmer 201 may include a phase-cut dimmer which may be separate from LED driver 202. For example, dimmer 201 may include a slide actuator that can be physically adjusted by a user. In these examples, LED driver 202 may be included as part of a light source (e.g., built into a light bulb). However, in other examples, dimmer 201 and LED driver 202 may be a single component. For example, an LED driver may include a dimmer, as described further with reference to FIG. 3.

Dimmer 201 and LED driver 202 may control the brightness of the light emitted by light source 205. For example, dimmer 201 may receive an input voltage VIN (e.g., an AC input voltage) and an indication of a desired brightness of light source 205 (e.g., by a user physically adjusting a slide actuator). Dimmer 201 may adjust the input voltage VIN (e.g., by cutting a portion of an AC voltage waveform) based on the position of the slide actuator and may output the adjusted voltage. LED driver 202 may receive a signal indicative of a desired brightness of light source 205 (e.g., the adjusted voltage received from dimmer 201) and may output a signal (e.g., output voltage $V_{OUT}$) to light source 205 in order to control the brightness of the light emitted by light source 205. For example, by outputting the output voltage $V_{OUT}$, LED driver 202 may supply a current to light source 205. Increasing the output current may increase the brightness of the light emitted by light source 205.

Light source 205 may include a plurality of LEDs, such as Low CCT LED 206 and High CCT LED 208 (collectively, LEDs 206 and 208). As illustrated in FIG. 2, a first terminal of Low CCT LED 206 may be coupled to a first terminal of High CCT LED 208. Low CCT LED 206 may represent a single LED or an array of LEDs. Likewise, High CCT LED 208 may represent a single LED or an array of LEDs. In some examples, Low CCT LED 206 may emit a warm white light with a CCT between approximately 2200K and approximately 3500K and High CCT LED 208 may emit a cool white light with a CCT between approximately 3500K and approximately 7000K. For example, Low CCT LED 206 may emit light with a CCT of approximately 2700K and High CCT LED 208 may emit light with a CCT of approximately 6500K. In some examples, the forward voltage drop of Low CCT LED 206 may be approximately equal to the forward voltage drop of High CCT LED 208.

Light source 205 may include a plurality of transistors Q1 and Q2 and a plurality of resistors R1 and R2. As illustrated in FIG. 2, transistors Q1 and Q2 include NPN BJT transistors. However, in other examples, other types of transistors may be used, such as PNP BJTs, MOSFETS, or the like. In some examples, as illustrated in FIG. 2, a second terminal of Low CCT LED 206 may be coupled to a collector or emitter of transistor Q1, a second terminal of High CCT LED 208 may be coupled to a collector or emitter of transistor Q2, the base of transistor Q1 may be coupled (e.g., via resistor R1) to pulse modulation device 214, and the base of transistor Q2 may be coupled (e.g., via resistor R2) to either the collector or the emitter of transistor Q1. In other examples, the positions of Low CCT LED 206 and High CCT LED 208 may be switched such that the second terminal of High CCT LED 208 may be coupled to the collector or emitter of transistor Q1 and the second terminal of Low CCT LED 206 may be coupled to the collector or emitter of transistor Q2.

Controller 204 may include a pulse modulation device 214 which may control the CCT of the light emitted by light source 205. For example, pulse modulation device 214 may provide a pulse modulated signal to one or more of transistors Q1 and Q2. The pulse modulated signal may cause transistors Q1 and Q2 to transition between an open-state and a closed-state, which may control the flow of current through LEDs 206 and 208. The pulse modulation device may operate according to pulse density modulation (PDM), pulse width modulation (PWM), pulse frequency modulation (PFM), or another suitable modulation technique.

Pulse modulation device 214 may receive a signal indicative of a desired color of light and may output a control signal based on the indication of the desired color of light. For example, pulse modulation device 214 may be connected to a physical control device (e.g., a slide actuator, rotating control knob, or the like). In some examples, a user may indicate a desired color of light by adjusting the control device, which may output a signal indicative of the desired color of light. Pulse modulation device 214 may receive the signal indicative of the desired color of light from the control device and may output, based on the received signal, a pulse modulated signal to transistor Q1. In some examples, the pulse modulation device may output a pulse modulated signal by alternately outputting a logical high signal and a logical low signal.

In some examples, a first signal of the logical high signal or the logical low signal may cause a first LED of Low CCT LED 206 and High CCT LED 208 to turn on, while the first signal may cause the other, second LED of Low CCT LED 206 and High CCT LED 208 to turn off. Likewise, a second signal of the logical high signal or the logical low signal may cause the first LED to turn off and cause the second LED to turn on. In other words, the logical signal may cause Low CCT LED 206 and High CCT LED 208 to turn on and off in complementary fashion. For example, when the pulse modulated signal is a first logical signal (e.g., logic high), transistor Q1 may turn on, which may cause transistor Q2 to turn off. When transistor Q1 is on, substantially all of the current supplied by LED driver 202 flows through Low CCT LED 206 (e.g., except for some leakage current) and substantially none of the current flows through High CCT LED 208 (e.g., except for the leakage current). As a result, Low CCT LED 206 may turn on and may emit light with a relatively low CCT as compared to High CCT LED 208, and High CCT LED 208 may turn off such that High CCT LED 208 does not emit light. Thus, at a given point in time, in some examples, either LED 206 or LED 208 receives substantially all of the current. However, because the pulse modulated signal rapidly switches between a logical high signal and a logical low signal, pulse modulation device 214 may adjust the proportion of the current received by LEDs 206 and 208 over a period of time. In contrast, when the pulse modulated signal is a second logical signal (e.g., logic low), transistor Q1 may turn off and transistor Q2 may turn on. When transistor Q1 is off, substantially all of the current output by LED driver 202 flows through LED 208 and transistor Q2 and substantially none of the current flows through LED 206. As a result, High CCT LED 208 may turn on and emit light with a relatively high CCT as compared to Low CCT LED 206, and Low CCT LED 206 may turn off such that Low CCT LED 206 does not emit light. In some examples, if transistor Q2 includes a BJT, transistor Q2 may include a high $H_{FE}$ in order to prevent the base biasing current from flowing through LED 206.

Pulse modulation device 214 may adjust the proportion of the current applied to Low CCT LED 206 and the proportion of the current applied to High CCT LED 208 by adjusting the duty cycle of the pulse modulated signal. For example, if Low CCT LED 206 emits light with a CCT of 2700K and High CCT LED 208 emits light with a CCT of 6500K, and pulse modulation device 214 receives a signal indicating that the desired color of light has a CCT equal to 4600K (e.g., halfway between the CCT of the respective LEDs 206 and 208), pulse modulation device 214 may set the duty cycle of the pulse modulated signal so that the CCT of the light emitted by light source 205 equals 4600K. For instance, pulse modulation device 214 may set the duty cycle to 40%, 50%, 60%, or any other value that causes light source 205 to emit light having a CCT that is halfway between the CCT of the light emitted by individual LEDs 206 and 208. For purposes of illustration only, if pulse modulation device 214 sets the duty cycle to 50%, the pulse modulated signal may include a logical high signal 50% of the time and a logical low signal 50% of the time, such that the proportion of the current applied to Low CCT LED 206 may equal 50% of the total current supplied by LED driver 202 and the proportion of the current applied to High CCT LED 208 may equal 50% of the total current supplied by LED driver 202. In other words, in some examples, the proportion of the current applied to Low CCT LED 206 may be equal to the duty cycle and the proportion of the current applied to High CCT LED 208 may be equal to the difference between the total current supplied by the LED driver 202 and the proportion of the current applied to Low CCT LED 206. In this way, Low CCT LED 206 may emit light 50% of the time and High CCT LED 208 may emit light 50% of the time, such that the apparent color of the light emitted by light source 205 has a CCT approximately equal to 4600K.

In accordance with one or more techniques of this disclosure, a light source may include two or more LEDs that emit different colors of light. In contrast to some LED light sources that require separate controls signals to control the different LEDs (e.g., a first control signal to control a low CCT LED and a second control signal to control a high CCT LED), the techniques of this disclosure may enable a pulse modulation device to control the two or more LEDs with a single pulse modulated signal. The pulse modulated signal may cause a first LED that emits a first color of light to turn on and cause a second LED that emits a second color of light to turn off. Conversely, the single pulse modulated signal may cause the first LED to turn off and may cause the second LED to turn on. By adjusting the duty cycle of the pulse modulated signal, the pulse modulation device may adjust the color of the light emitted by the light source. Using a single pulse modulation device and a single pulse modulated signal to adjust the color of light emitted by a light source may reduce the cost, size, and/or complexity of the lighting system.

Figure 3:
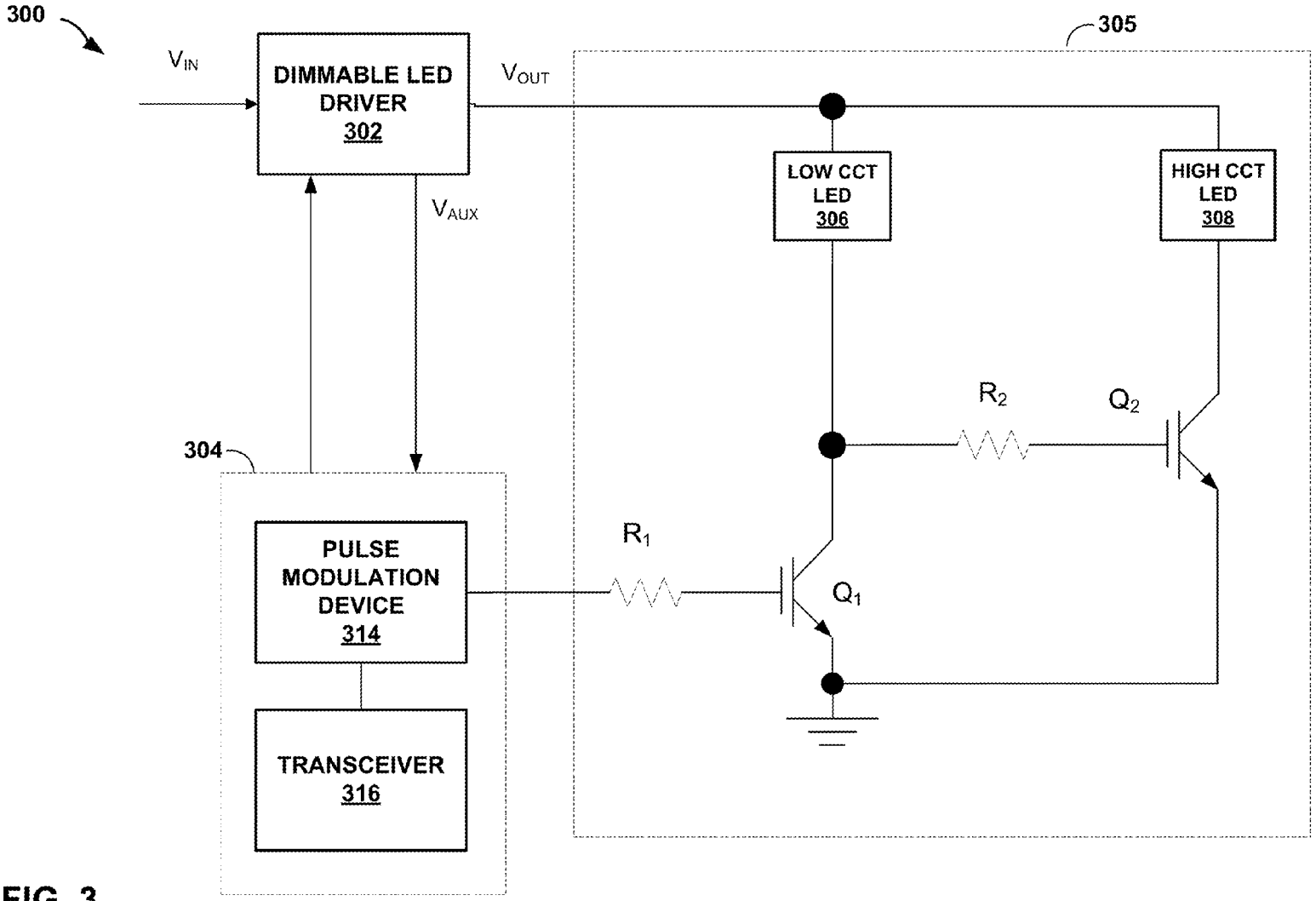
FIG. 3 is a circuit diagram illustrating an example LED lighting system, in accordance with an example of this disclosure.

FIG. 3 is a circuit diagram illustrating an example LED lighting system, in accordance with an example of this disclosure. LED lighting system 300 may be an example of LED lighting system 100 of FIG. 1. As illustrated in FIG. 3, LED lighting system 300 includes dimmable LED driver 302, controller 304, and light source 305.

Dimmable LED driver 302 may control the brightness of the light emitted by light source 305. For example, dimmable LED driver 302 may receive an input voltage VIN and an input signal indicative of a desired brightness of light source 305 (e.g., a voltage). Dimmable LED driver 302 may supply a constant current or constant power based on the input signal in order to control the brightness of the light emitted by light source 305. As illustrated in FIG. 3, in some examples, dimmable LED driver 302 may receive a signal indicative of the desired brightness of light source 305 from controller 304. In response to receiving the signal indicative of the desired brightness of light, dimmable LED driver 302 may supply a current to light source 305. In some examples, dimmable LED driver 302 may output an auxiliary voltage $V_{AUX}$ to controller 304, which may provide power to controller 304.

Light source 305 may be similar to light source 205 of FIG. 2. For example, light source 305 may include a plurality of LEDs, such as Low CCT LED 306 and High CCT LED 308 (collectively, LEDs 306 and 308). As illustrated in FIG. 3, a first terminal of Low CCT LED 306 may be coupled to a first terminal of High CCT LED 308. In some examples, Low CCT LED 306 may emit light with a first color and High CCT LED 308 may emit light with a second color. For example, Low CCT LED may emit a warm white light and High CCT LED 308 may emit a cool white LED, which may have similar forward voltage drops and may emit light in similar CCT ranges as described in FIG. 2. Similarly, light source 305 may include a plurality of transistors Q1 and Q2 and a plurality of resistors R1 and R2, as described with reference to FIG. 2. For example, transistors Q1 and Q2 may include NPN BJT transistors. One of LEDs 306 and 308 may be coupled to transistor Q1 and the other LED of LEDs 306 and 308 may be coupled to transistor Q2. For instance, as illustrated in FIG. 3, Low CCT LED 306 may be coupled to either the collector or emitter of transistor Q1 and High CCT LED 308 may be coupled to either the collector or emitter of transistor Q2.

Controller 304 may include a pulse modulation device 314 and at least one transceiver 316. The at least one transceiver 316 may include a wired transceiver, wireless transceiver, or both. For instance, transceiver 316 may communicate with an external device via a network using a communication interface such as Bluetooth radio, Wifi radio, cellular radio (e.g., 3G or LTE), Universal Serial Bus (USB), Ethernet, or the like. Transceiver 316 may be configured to receive a signal indicative of a desired brightness of light, a desired color of light, or both. For example, a user of an external device (e.g., a computing device, such as a smart phone) may input a desired brightness (e.g., via an application installed on the computing device). For instance, a smart phone may include an application to control the lighting in a room, such that a user of the smart phone may input a desired brightness and/or desired color of light). The external device may output an indication of the desired brightness and/or desired color of light (e.g. via Bluetooth). Transceiver 316 of controller 304 may receive the signal from the external device. In some examples, in response to receiving the signal from the external device, transceiver 316 may output a signal to pulse modulation device 314 indicative of the desired color of light. Likewise, in some examples, transceiver 316 may output a signal to dimmable LED driver 302 that indicates the desired brightness of light.

Pulse modulation device 314 may control the CCT of the light emitted by light source 305 by controlling transistors Q1 and Q2. For example, pulse modulated device 314 may receive the signal indicative of the desired color of the light from transceiver 316 and may output, based on the received signal, a pulse modulated signal (e.g., a PWM, PDM, or PFM signal) to one or more transistors of light source 305. The pulse modulated signal may cause transistors Q1 and Q2 to transition between an open-state and a closed-state, which may control flow of the current through LEDs 306 and 308.

In some examples, the pulse modulated signal output by the pulse modulation device may alternate between a logical high signal and a logical low signal. In some examples, when the pulse modulated signal is a logical high signal, transistor Q1 may turn on, which may cause transistor Q2 to turn off. As a result, substantially all of the current output by LED driver 302 flows through Low CCT LED 306 and transistor Q1 (e.g., except for a leakage current) and substantially none of the current flows through High CCT LED 308 (e.g., except for a leakage current). Thus, a logical high signal may cause Low CCT LED 306 to emit light associated with a relatively low CCT (as compared to High CCT LED 308), and may cause High CCT LED 308 to not emit light. In contrast, when the pulse modulated signal is a logical low signal, transistor Q1 may turn off. Turning transistor Q1 off may cause transistor Q2 to turn on, such that substantially all of the current supplied by LED driver 302 flows through L High CCT ED 308 and transistor Q6 and substantially none of the current flows through Low CCT LED 306. As a result, High CCT LED 308 may emit light associated with a relatively high CCT (as compared to Low CCT LED 306), and Low CCT LED 306 may not emit light.

Pulse modulation device 314 may adjust the proportion of the current applied to Low CCT LED 306 and the proportion of the current applied to High CCT LED 308 by adjusting the duty cycle of the pulse modulated signal. For example, pulse modulation device 314 may receive a signal indicative of a desired CCT that is greater than the CCT of the light emitted by Low CCT LED 306 and that is less than the CCT of the light emitted by High CCT LED 308. Pulse modulation device 314 may adjust the duty cycle of the pulse modulated signal in order cause light source 305 to emit light with the desired CCT. For instance, if Low CCT LED 306 emits light with a CCT equal to 3000K and High CCT LED 308 emits light with a CCT equal to 6000K, and pulse modulation device 314 receives a signal indicating that the desired CCT equals 3300K, pulse modulation device 314 may output a pulse modulated signal so that the CCT of the light emitted by light source 305 equals 3300K. For instance, pulse modulation device 214 may set the duty cycle to 60%, 75%, 90%, or any other value that causes light source 305 to emit light having a CCT of 3300K. For purposes of illustration only, if pulse modulation device 214 sets the duty cycle to 90%, pulse modulation device 314 may output a logical high signal 90% of the time and a logical low signal 10% of the time. As a result, the proportion of the current applied to Low CCT LED 306 may equal 90% of the total current and the proportion of the current applied to High CCT LED 308 may equal 10% of the total current (in other words, the proportion of the current applied to Low CCT LED 306 may be equal to the duty cycle of the pulse modulated signal). In this way, Low CCT LED 306 may emit light 90% of the time and High CCT LED 308 may emit light 10% of the time, such that the apparent color of the light emitted by light source 305 has a CCT approximately equal to 3300K.

Figure 4:
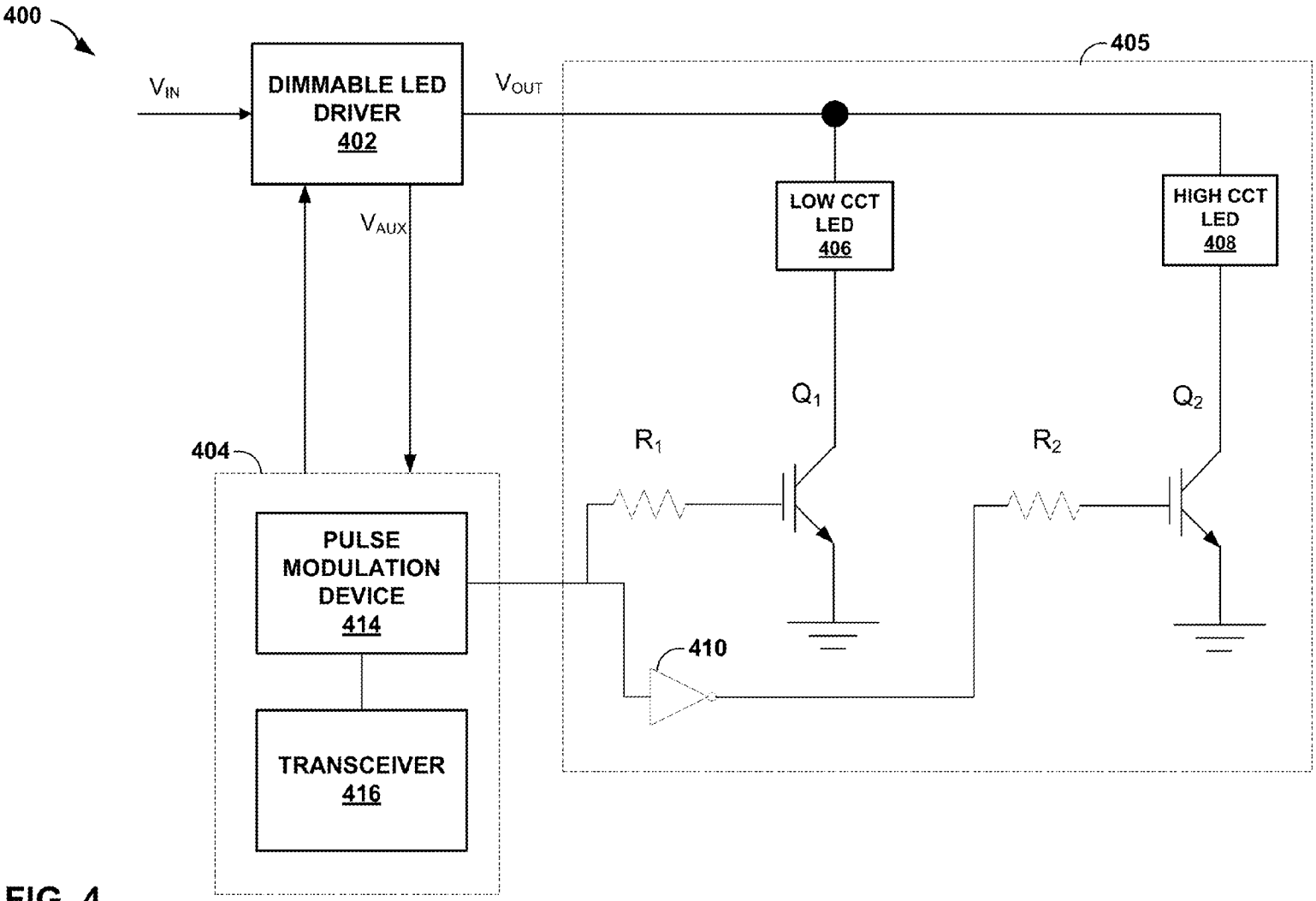
FIG. 4 is a circuit diagram illustrating an example LED lighting system, in accordance with an example of this disclosure.

FIG. 4 is a circuit diagram illustrating an example LED lighting system, in accordance with an example of this disclosure. LED lighting system 400 may be an example of LED lighting system 100 of FIG. 1. As illustrated in FIG. 4, LED lighting system 400 includes dimmable LED driver 402, controller 404, and light source 405. In some examples, dimmable LED driver 402 may be similar to dimmable LED driver 302, as described with reference to FIG. 3. Likewise, in some examples, controller 404 may include pulse modulation device 414 and transceiver 416, which may be similar to pulse modulation device 314 and transceiver 316 respectively, as described with reference to FIG. Similarly, light source 405 may include Low CCT LED 406 and High CCT LED 408, which may be similar to Low CCT LED 306 and High CCT LED 308 of FIG. 3, respectively.

In some examples, light source 405 may include a plurality of transistors Q1 and Q2 and a plurality of resistors R1 and R2. Transistors Q1 and Q2 may include any suitable type of transistors, such as the transistors described with reference to FIGS. 1-3. In contrast to the transistors of FIGS. 2 and 3, in some examples, the base of transistor Q2 may not be coupled to the collector or emitter of transistor Q1. For example, as illustrated in FIG. 4, each of transistors Q1 and Q2 may be coupled to pulse modulation device 414. For instance, transistor Q1 may be coupled to pulse modulation device 414 via resistor R1 and transistor Q2 may be coupled to pulse modulation device 414 via resistor R2 and inverter 410. Pulse modulation device 414 may output a pulse modulated signal to control the proportion of the current applied to Low CCT LED 406 and High CCT LED 408. In some examples, one of transistors Q1 and Q2 may be coupled to pulse modulation device 414 via an inverter 410. For instance, as illustrated in FIG. 4, transistor Q2 may be coupled to pulse modulation device 414 via inverter 410. Inverter 410 may receive the pulse modulated signal from pulse modulation device 414 and may output an inverted signal to transistor Q2. Thus, in some examples, when pulse modulation device 414 outputs a logical high signal, transistor Q1 may receive the logical high signal, which may cause transistor Q1 to turn on. At the same time, inverter 410 may output a logical low signal to transistor Q2 which may cause transistor Q2 to turn off. As a result, substantially all of the current supplied by LED driver 402 may flow through Low CCT LED 406 and substantially none of the current may flow through High CCT LED 408. Thus, Low CCT LED 406 may turn on such that it may emit light, while High CCT LED 408 may turn off such that it does not emit light. Conversely, in some examples, when pulse modulation device 414 outputs a logical low signal, transistor Q1 may turn off such that no current flows through Low CCT LED 406. In these examples, inverter 410 receive the logical signal from pulse modulation device 414 and may output a logical high signal to transistor Q2, which may cause transistor Q2 to turn on. As a result, substantially all of the current may flow through High CCT LED 408.

Pulse modulation device 414 may adjust the proportion of the current applied to Low CCT LED 406 and the proportion of the current applied to High CCT LED 408 by adjusting the duty cycle of the pulse modulated signal. For example, as illustrated in FIG. 4, pulse modulation device 414 may increase the duty cycle of the pulse modulated signal to increase the percentage of time the pulse modulated signal is a logical high signal, which may increase the proportion of the current applied to Low CCT LED 406. Similarly, pulse modulation device 414 may decrease the duty cycle of the pulse modulated signal to increase the percentage of time the pulse modulated signal is a logical low signal, which may increase the proportion of the current applied to High CCT LED 408. In some examples, the proportion of the current applied to one of LEDs 406 and 408 may be equal to the duty cycle of the pulse modulated signal. For example, as illustrated in FIG. 4, the proportion of the current applied to Low CCT LED 406 may be equal to the duty cycle of the pulse modulated signal and the proportion of the current applied to High CCT LED 408 may be equal to the difference between the total current and the proportion of the current applied to Low CCT LED 406.

Figure 5:
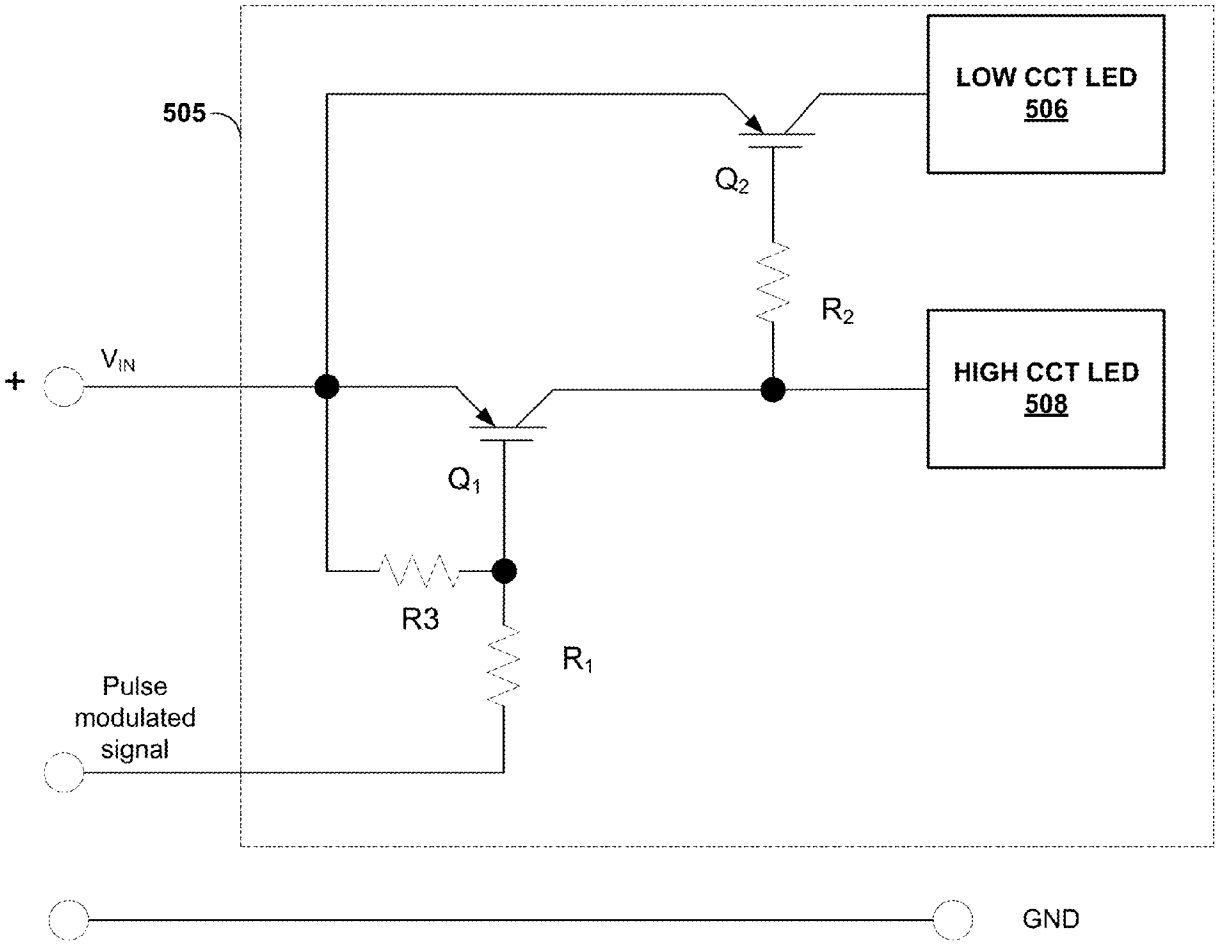
FIG. 5 is a circuit diagram illustrating an example LED lighting system, in accordance with an example of this disclosure.

FIG. 5 is a circuit diagram illustrating an example LED lighting system, in accordance with an example of this disclosure. LED lighting system 500 may be an example of LED lighting system 100 of FIG. 1. As illustrated in FIG. 5, LED lighting system 500 includes an LED driver, a controller including a pulse modulation device, and light source 505. For ease of illustration, and to reduce repetition of description, the controller and LED driver are not shown in FIG. 5.

Light source 505 may include Low CCT LED 506 and High CCT LED 508, as previously described in the FIGS. 1-4. In some example, light source 505 may also include a plurality of transistors Q1 and Q2 and a plurality of resistors R1, R2, and R3. As illustrated in FIG. 5, transistors Q1 and Q2 may include PNP BJT transistors.

The pulse modulation device may output a pulse modulated signal to turn on transistor Q1 and turn off transistor Q2, as previously described with reference to FIGS. 2-4. The pulse modulation device may adjust the duty cycle of the pulse modulated signal in order to adjust the proportion of time that transistor Q1 is on relative to the proportion of time that transistor Q2 is on. By adjusting the duty cycle of the pulse modulated signal, the pulse modulation device may adjust the proportion of the current applied to Low CCT LED 506 and the proportion of the current applied to High CCT LED 508. In some examples, the proportion of the current applied to Low CCT LED 506 may be equal to the duty cycle of the pulse modulated signal and the proportion of the current applied to High CCT LED 508 may be equal to the difference between the total current supplied by the LED driver and the proportion of the current applied to Low CCT LED 506. In other examples, the proportion of the current applied to High CCT LED 508 may be equal to the duty cycle of the pulse modulated signal and the proportion of the current applied to Low CCT LED 506 may be equal to the difference between the total current supplied by the LED driver and the proportion of the current applied to High CCT LED 508.

Figure 6:
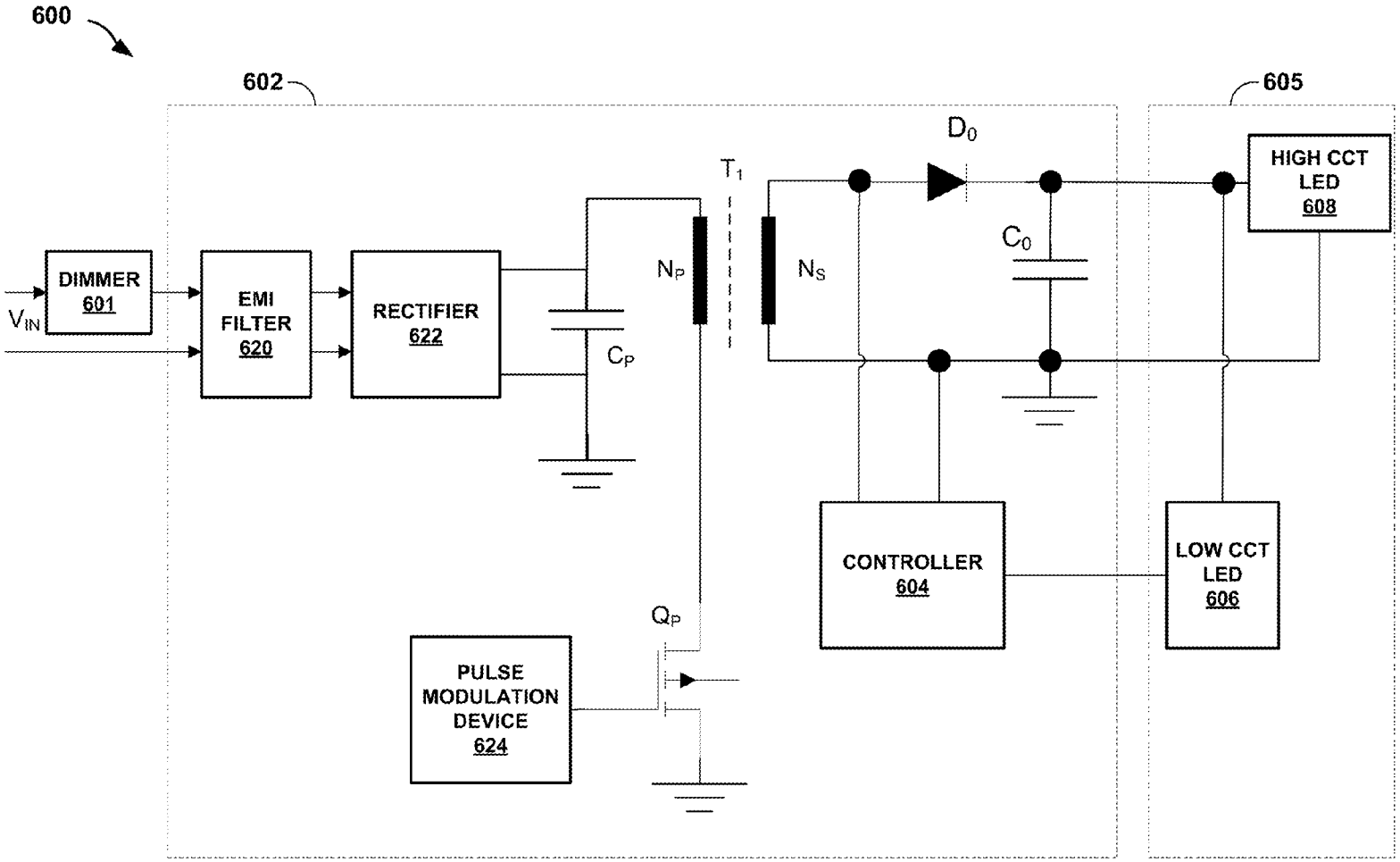
FIG. 6 is a circuit diagram illustrating an example LED lighting system, in accordance with an example of this disclosure.

FIG. 6 is a circuit diagram illustrating an example of the LED lighting system of FIG. 1, in accordance with an example of this disclosure. LED lighting system 600 may be an example of LED lighting system 100 of FIG. 1. As illustrated in FIG. 6, LED lighting system 600 includes dimmer 601, LED driver 602, and light source 605.

Light source 605 may include a plurality of LEDs, such as Low CCT LED 606 and High CCT LED 608 (collectively, LEDs 606 and 608). As illustrated in FIG. 6, LEDs 606 and 608 may be coupled in parallel. Low CCT LED 606 may represent a single LED or an array of LEDs. Likewise, High CCT LED 608 may represent a single LED or an array of LEDs. In some examples, Low CCT LED 606 may emit light with a first color and High CCT LED 608 may emit light with a second, different color. For example, Low CCT LED 606 may emit an amber colored light with a CCT between approximately 1800K and approximately 3300K and High CCT LED 608 may emit a white light with a CCT between approximately 5000K and approximately 6500K. For example, Low CCT LED 606 may emit light with a CCT of approximately 2000K and High CCT LED 608 may emit light with a CCT of approximately 5500K. In some examples, the forward voltage of Low CCT LED 606 may be less than the forward voltage of High CCT LED 608.

Dimmer 601 may be an example of dimmer 101 of FIG. 1. In some examples, dimmer 601 includes a phase-cut dimmer. In some examples, dimmer 601 may be separate from LED driver 602. For example, dimmer 601 may include a dimmer switch installed in a wall and LED driver 602 may be included as part of a light source (e.g., built into a light bulb). However, in other examples, dimmer 601 and LED driver 602 may be a single component. In some examples, dimmer 601 may control the brightness and CCT of the light emitted by light source 605, as described in more detail below.

LED driver 602 may include a transformer $T_1$ that includes a primary-side winding $N_S$ and a secondary-side winding $N_P$. Transformer $T_1$ may include a step-down transformer which may convert a voltage on the primary-side of transformer $T_1$ from one voltage to a lower voltage on the secondary-side of transformer $T_1$. For example, the number of coils in secondary-side winding $N_S$ may be a fraction (e.g., one-third, one-fourth, one-tenth, one-fiftieth etc.) the number of coils in primary-side winding $N_P$. For example, if primary-side winding $N_P$ includes forty times (e.g., 40×) the number of windings that are in secondary-side winding $N_S$, the voltage on the secondary-side of transformer $T_1$ may be approximately equal to one-fortieth of the voltage on the primary-side of transformer $T_1$.

In some examples, LED driver 602 may also include an electromagnetic interference (EMI) filter 620, rectifier 622, pulse modulation device 624, primary-side capacitor $C_P$, and primary-side transistor $Q_P$ on the primary-side of transformer $T_1$. On the secondary-side of transformer $T_1$, LED driver 202 may include a controller 604, diode $D_0$, and capacitor $C_0$.

EMI filter 620 may receive an AC voltage from dimmer 601 and may output a filtered AC voltage to rectifier 622. Rectifier 622 may receive the filtered AC voltage from EMI filter 620, convert the filtered AC voltage to a DC voltage, and output the DC voltage. Primary-side capacitor $C_P$ may help smooth out ripples in the output DC voltage. The DC voltage may induce a current through primary-side winding $N_P$. Pulse modulation device 624 and primary-side transistor $Q_P$ may regulate the power output by LED driver 602. For example, if the voltage output by dimmer 201 decreases, pulse modulation device 624 may decrease the duty cycle of primary-side transistor $Q_P$ in order to decrease the amount of the power delivered to the secondary side winding $N_S$, which may decrease the current at the secondary-side of transformer $T_1$. The current through secondary-side winding $N_S$ may charge capacitor $C_0$ through diode $D_0$.

In some examples, controller 604 may receive a signal indicative of a desired color of light and may output a control signal based on the indication of the desired color of light. For example, the voltage at primary-side winding $N_P$ may cause a current to flow through secondary-side winding $N_S$. The current at secondary-side winding $N_S$ may be indicative of a dimming level of light source 605 and may also be indicative of a desired color of light. For instance, as the current to light source 605 decreases, the brightness and CCT of the light emitted by light source 605 may decrease. Controller 604 may receive the current from secondary-side winding $N_S$ and may generate a negative voltage that is almost proportional to the average (e.g., root mean squared (RMS)) voltage applied to the primary-side winding $N_P$. For example, if the average voltage output by dimmer 601 equals 120V and primary-side winding $N_P$ includes 40× the number of windings as secondary-side winding $N_S$, controller 604 and secondary-side winding $N_S$ may generate a negative voltage approximately equal to negative three volts. Controller 604 may, subtract the negative voltage from a positive voltage in order to generate a transistor voltage. The transistor voltage may be applied to one or more transistors connected to at least one LED array (e.g., Low CCT LED 606 or High CCT LED 608) of light source 605 so as to produce desired CCT.

The proportion of the current applied to Low CCT LED 606 and the proportion of current applied to High CCT LED 608 may be based on the transistor voltage applied to the transistor. For example, if Low CCT LED 606 is coupled to a transistor and the transistor voltage (i.e., the result of combining the negative voltage and the positive voltage) applied to the base of the transistor is less than the threshold turn-on voltage of the transistor, the transistor may remain off such that substantially no current flows through Low CCT LED 606 and substantially all of the current flows through High CCT LED 608. If the voltage output by dimmer 201 decreases, the voltage applied to the transistor may increase beyond the threshold turn on voltage of the transistor (e.g., 0.7V) such that the transistor may turn on. As a result, at least some of the current supplied by secondary winding $N_S$ may flow through the transistor and Low CCT LED 606. Thus, the proportion of the total current that is applied to Low CCT LED 606 may increase (e.g., from approximately 0% to approximately 25%) and the proportion of the current that is applied to High CCT LED 608 may decrease (e.g., from approximately 100% to approximately 75%). As the proportion of the current applied to Low CCT LED 606 increases and the proportion of the current applied to High CCT LED 608 decreases, Low CCT LED 606 contributes relatively more to the light output light source 605 (relative to the light contributed by High CCT LED 608), such that the CCT of the light emitted by light source 605 may decrease (e.g., from 4000K to 3500K). In some examples, as the voltage output by dimmer 201 decreases, the total current supplied by secondary-side winding $N_S$ may decrease such that the brightness of the light emitted by light source 605 may decrease.

In accordance with one or more techniques of this disclosure, a light source may include two or more LEDs that emit different colors of light. A controller may receive a current indicative of a desired color of light and may apply a voltage to a transistor to control the proportion of current applied to a first LED and a second LED. By adjusting the proportion of the current applied to the different LEDs, the controller may adjust the color and brightness of light emitted by the light source. Using a single controller and a signal control signal to adjust both the color and brightness of the light emitted by the light source may reduce the cost, size, and/or complexity of the lighting system. In contrast to some LED light sources which utilize dedicated LED controllers to control the brightness and CCT of the light emitted by the light source, or which have high board to board tolerance, and hence have high costs, the techniques of this disclosure may enable a device to control the brightness and CCT of the light emitted by the light source using a relatively simple circuit with relatively low board to board tolerance.

Figure 7:
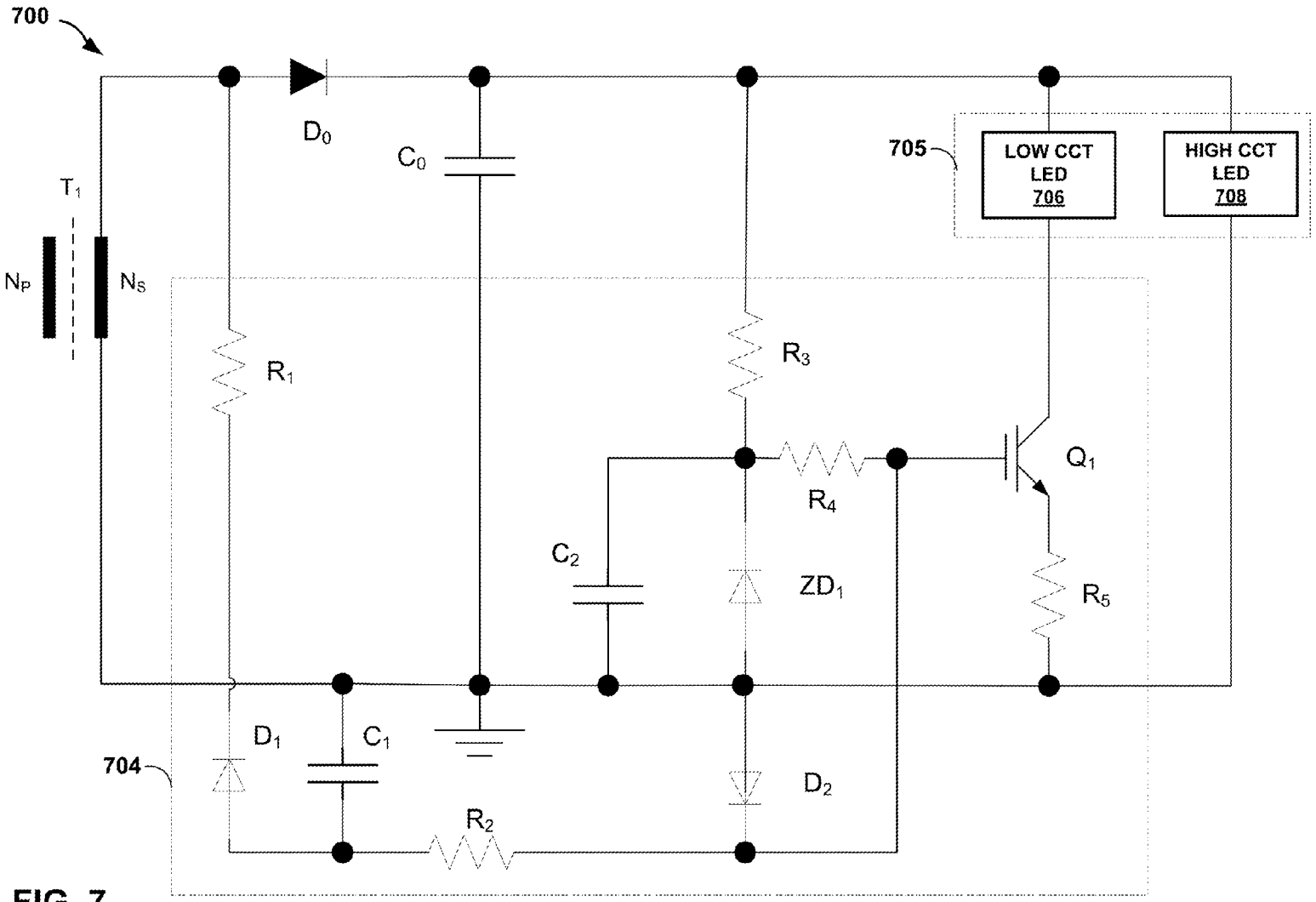
FIG. 7 is a circuit diagram illustrating an example LED lighting system, in accordance with an example of this disclosure.

FIG. 7 is a circuit diagram illustrating further details of a controller of an example LED lighting system, in accordance with an example of this disclosure. LED lighting system 700 may be an example of LED lighting system 600 of FIG. 6. As illustrated in FIG. 7, LED lighting system 700 includes transformer $T_1$, controller 704, light source 705, diode $D_0$ and capacitor $C_0$. Controller 704 may be an example of controller 704 of FIG. 6.

Light source 705 may be similar to light source 605 of FIG. 6. For example, light source 605 may include a plurality of LEDs, such as Low CCT LED 706 and High CCT LED 708 (collectively, LEDs 706 and 708). As illustrated in FIG. 7, a first terminal of Low CCT LED 706 may be coupled to a first terminal of High CCT LED 708. Low CCT LED 706 may represent a single LED or an array of LEDs. Likewise, High CCT LED 708 may represent a single LED or an array of LEDs. In some examples, Low CCT LED 706 may emit light with a first color and High CCT LED 708 may emit light with a second, different color. For example, Low CCT LED 706 may emit an amber colored light and High CCT LED 708 may emit a white light, where the CCT of the light emitted by the respective LEDs may be similar to the CCT ranges described in FIG. 6. In some examples, Low CCT LED 706 may emit light with a CCT of approximately 2000K and High CCT LED 708 may emit light with a CCT of approximately 5500K. In some examples, the forward voltage of Low CCT LED 706 may be less than the forward voltage of High CCT LED 708.

Transformer $T_1$ may be an example of transformer $T_1$ of FIG. 6. For example, the number of coils at primary-side winding $N_P$ may include a multiple (e.g., 10×, 20×, 30×) the number of coils at secondary-side winding $N_S$. For example, if the primary-side winding $N_P$ includes 40× the number of coils as secondary-side winding $N_S$, the voltage at the secondary-side of transformer $T_1$ may be approximately equal to one-fortieth of the voltage on the primary-side of transformer $T_1$.

Controller 704 may include resistors R1, R2, R3, R4, and R5, diodes D1, D2 and ZD1 (which may include a Zener diode), capacitors C1 and C2, and transistor Q1. Resistors R3, R4, and R5, capacitor C2, diode ZD1, and transistor Q1 may operate as a voltage controlled current sink. As illustrated in FIG. 7, transistor Q1 may include an NPN BJT transistor. However, in other examples, other types of transistors may be used, such as a PNP BJT, a MOSFET, or the like.

In some examples, controller 704 may receive a signal indicative of a desired color of light and may output a control signal based on the indication of the desired color of light. For example, the voltage at primary-side winding $N_P$ may cause a current to flow through secondary-side winding $N_S$. The current at secondary-side winding $N_S$ may be indicative of a dimming level of light source 705 and may also be indicative of a desired color of light. For instance, as the current to light source 705 decreases, the brightness and CCT of the light emitted by light source 705 may decrease. Controller 704 may receive the current from secondary-side winding $N_S$ and may generate a negative voltage that is approximately proportional to the average (e.g., RMS) voltage applied to the primary-side winding $N_P$. For example, if the average voltage output by dimmer 701 equals 120V and primary-side winding $N_P$ includes 40× the number of windings as secondary-side winding $N_S$, controller 704 and secondary-side winding $N_S$ may generate a negative voltage approximately equal to negative three volts.

In some examples, controller 704 may include a transistor coupled to one of Low CCT LED 706 or High CCT LED 708. For example, transistor Q1 may be connected in series to a second terminal of Low CCT LED 706. The negative voltage may be subtracted from a positive voltage and the resulting voltage may be applied to transistor Q1. In some examples, if the resulting voltage applied to transistor Q1 is less than a threshold turn-on voltage (e.g., 0.7 volts) of transistor Q1, the transistor may remain off. When transistor Q1 is off, substantially none of the current (e.g., except for a leakage current) flows through Low CCT LED 706 and substantially all of the current flows through High CCT LED 708. In other words, when the negative voltage is less than the turn-on voltage of transistor Q1, the proportion of the current applied to Low CCT LED 706 may equal approximately 0% of the current (e.g., approximately 0% due to some leakage current) and the proportion of the current applied to High CCT LED 708 may equal approximately 100% of the current supplied by secondary-side winding $N_S$. As a result, High CCT LED 708 may emit light with a first CCT and Low CCT LED 706 may not emit light. In this manner, the CCT of the light emitted by light source 705 may be equal to the CCT of the light emitted by High CCT LED 708. In other examples, the position of Low CCT LED 706 and High CCT LED 708 may be switched such that transistor Q2 is coupled to High CCT LED 706.

In some examples, a dimmer (e.g., dimmer 601 of FIG. 6) may reduce the voltage applied to primary-side winding $N_P$ from 120V to 40V. Continuing the example above where primary-side winding $N_S$ includes 40× more coils than secondary-side winding $N_P$, controller 704, secondary-side winding $N_S$ may generate, based on the voltage at the primary-side winding and based on the ratio of the windings, a voltage approximately equal to negative one volt (e.g., negative 1V). The negative voltage may be combined with the positive voltage to generate a transistor voltage which may be applied to transistor Q1. In some examples, in response to receiving a voltage greater than the threshold turn-on voltage (e.g., 0.7V) of transistor Q1, transistor Q1 may turn on, thus allowing current to flow through Low CCT LED 706. For example, the proportion of the current applied to Low CCT LED 706 may be equal to approximately 20% of the total current supplied by secondary-side winding $N_S$, and the proportion of the current applied to High CCT LED 708 may be equal to approximately 80% of the total current supplied by secondary-side winding $N_S$. In other words, controller 704 may increase the proportion of the current applied to Low CCT LED 606 by increasing the negative voltage (e.g., from negative 3 volts to negative 1 volts) and thereby increasing the transistor voltage applied to the transistor to a voltage that is greater than the turn-on voltage of transistor Q1. As a result, High CCT LED 708 may continue to emit light with the first CCT and Low CCT LED may emit light with a second CCT, such that CCT of the light emitted by light source 705 may be less than the CCT of the light emitted by the High CCT LED 708 and greater than the CCT of the light emitted by Low CCT LED 706. In some examples, because the total current flowing through the secondary-side winding $N_P$ decreases as the voltage output by the dimmer decreases, the brightness of the light emitted by light source 705 decreases. Thus, as the dimmer decreases the voltage applied to primary-side winding $N_P$, the light emitted by light source 705 may be less bright and may change color (e.g., from a High CCT to a lower CCT).

In some examples, a user may desire to change the CCT of the light emitted by light source 705 and may adjust the dimmer accordingly. The dimmer may reduce the voltage at the primary-side winding Ni even further. For example, the dimmer may reduce the voltage applied to primary-side winding $N_P$ from 40V to 20V. Controller 704 and secondary-side winding $N_S$ may generate a voltage approximately equal to negative 0.5 volts (e.g., 0.5V equals one-fortieth of 20V). The negative voltage may be subtracted from the positive voltage. If the resulting voltage is greater than the threshold turn-on voltage of transistor Q1, current flows through transistor Q1 and Low CCT LED 706. In some examples, the voltage at the secondary-side of transformer $T_1$ may be less than the forward voltage of High CCT LED 708, such that current may not flow through High CCT LED 708. As a result, when the voltage at the secondary-side winding $N_P$ is less that the forward voltage of High CCT LED 708, substantially all of the current flows through Low CCT LED 706 (e.g., except for a leakage current) and substantially none of the current flows through High CCT LED 708. In other words, the proportion of the current applied to Low CCT LED 706 is approximately 100% of the total current supplied by secondary-side winding $N_S$ and the proportion of the current applied to High CCT LED 708 is approximately 0% of the total current supplied by secondary-side winding $N_S$. In some examples, because the forward voltage of Low CCT LED 706 may be less than the forward voltage of High CCT LED 708, Low CCT LED 706 may emit light when High CCT LED 708 does not emit light.

Figure 8:
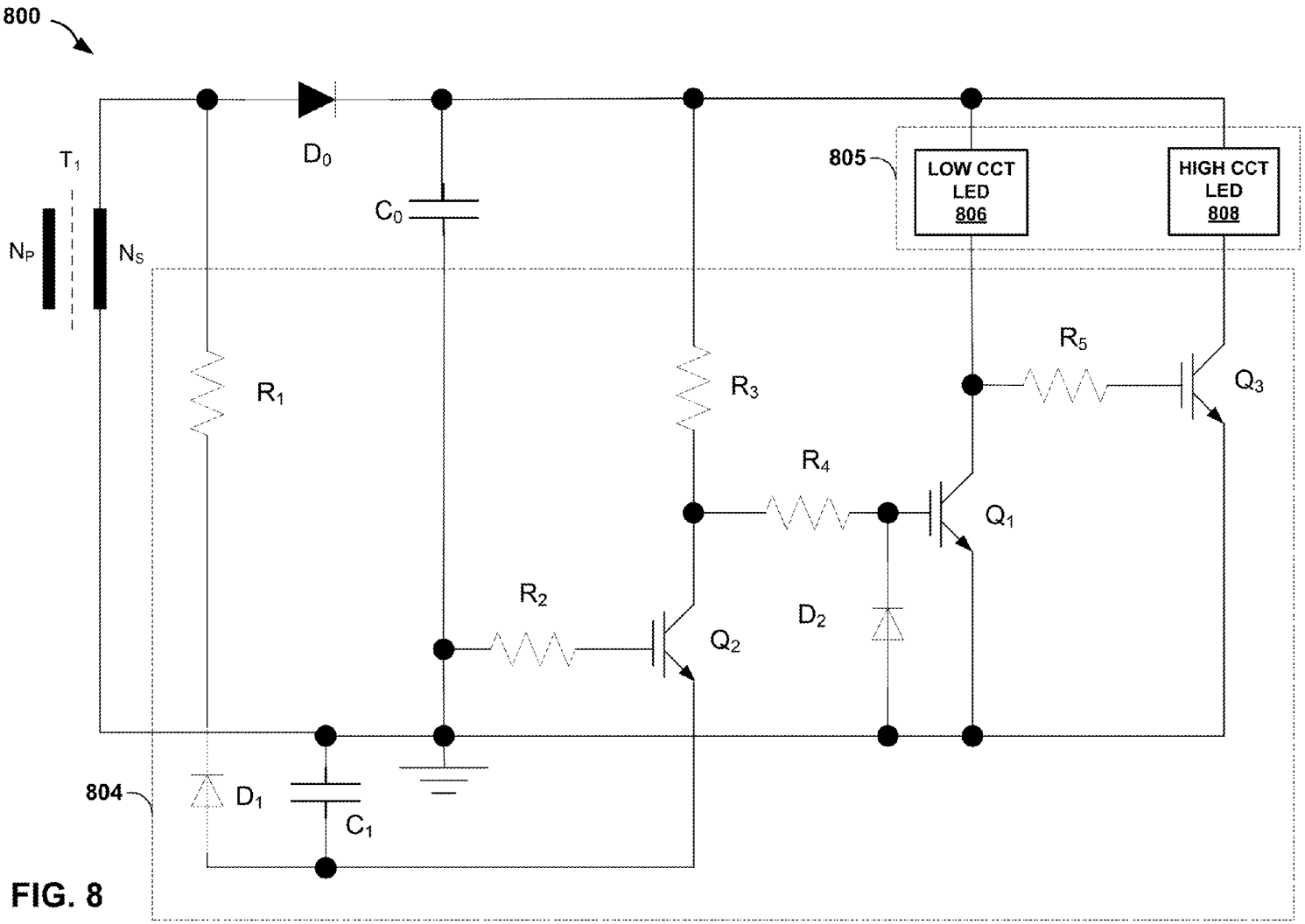
FIG. 8 is a circuit diagram illustrating an example LED lighting system, in accordance with an example of this disclosure.

FIG. 8 is a circuit diagram illustrating further details of a controller of an example LED lighting system, in accordance with an example of this disclosure. LED lighting system 800 may be an example of LED lighting system 600 of FIG. 6. As illustrated in FIG. 8, LED lighting system 800 includes transformer $T_1$, controller 804, light source 805, diode $D_0$ and capacitor $C_0$. Controller 804 may be an example of controller 604 of FIG. 6. Light source 805 may include Low CCT LED 806 and High CCT LED 808 (collectively, LEDs 806 and 808), which may be similar to Low CCT LEDs 606, 706 and High CCT LEDs 608, 708 of FIGS. 6 and 7, respectively. For instance, a first terminal of Low CCT LED 806 may be coupled to a first terminal of High CCT LED 808.

Controller 804 may include resistors R1, R2, R3, R4, and R5, diodes D1, and D2, capacitor C1, and transistors Q1, Q2, and Q3. As illustrated in FIG. 8, transistors Q1, Q2, and Q3 include NPN BJT transistors. However, in other examples, other types of transistors may be used (e.g., PNP BJTs, MOSFETs, or the like). In some examples, a transistor may be coupled in series with each LED of LEDs 806 and 808. For instance, as illustrated in FIG. 8, transistor Q1 may be coupled in series to a second terminal of Low CCT LED 806 and transistor Q3 may be coupled in series to a second terminal of High CCT LED 808. In some examples, as illustrated in FIG. 8, a first terminal of Low CCT LED 806 may be coupled to a first terminal of High CCT LED 808, a second terminal of Low CCT LED 806 may be coupled to a collector or emitter of transistor Q1, a second terminal of High CCT LED 808 may be coupled to a collector or emitter of transistor Q3, and the base of transistor Q3 may be coupled (e.g., via resistor R5) to either the collector or the emitter of transistor Q1. In other examples, the positions of Low CCT LED 806 and High CCT LED 808 may be switched such that transistor Q1 may be coupled in series to High CCT LED 808 and transistor Q3 may be coupled in series to Low CCT LED 806.

Transformer $T_1$ may include a step-down transformer similar to transformer $T_1$ of FIGS. 6 and 7. For example, primary-side winding $N_P$ may include 40× the number of coils as secondary-side winding $N_S$. It is to be understood that the ratio of coils throughout the description are merely examples and that other ratios may exist.

Primary-side winding $N_P$ of transformer $T_1$ may generate a current in secondary-side winding $N_S$ of transformer. Secondary-side winding $N_S$, resistor R1, diode D1, and capacitor C1 may produce a negative voltage that is approximately proportional to the average voltage at primary-side winding $N_P$. Controller 804 may subtract the negative voltage from a positive voltage and apply the resulting voltage to transistor Q1. If the resulting voltage is above a threshold turn-on voltage of transistor Q1, transistor Q1 may turn on. In the example of FIG. 8, turning on transistor Q1 may cause transistor Q3 to turn off. Thus, substantially all of the current from secondary-side winding $N_S$ flows through Low CCT LED 806 (e.g., except for a leakage current) and substantially none of the current (e.g., except for a leakage current) flows through High CCT LED 808. As a result, Low CCT LED 806 may turn emit light associated with a relatively low CCT as compared to High CCT LED 808, and High CCT LED 808 may not emit light. In contrast, when the negative voltage is less than the threshold turn-on voltage of transistor Q1, transistor Q1 may turn off and transistor Q2 may turn on. When transistor Q1 is off and transistor Q2 is on, substantially all of the current from secondary-side winding $N_S$ flows through LED 808 and transistor Q2 and substantially none of the current flows through LED 806. As a result, High CCT LED 808 may turn emit light associated with a relatively high CCT as compared to Low CCT LED 806, and Low CCT LED 806 may not emit light. Transistor Q1 may turn on and transistor Q3 may turn off with a duty cycle proportional to the phase angle of the voltage and current at secondary-side winding $N_S$. In other words, Low CCT LED 806 and High CCT LED 808 may alternately turn on and off, such that the CCT of the light emitted by light source 805 may be greater than the CCT of the light emitted by Low CCT LED 806 and less than the CCT of the light emitted by High CCT LED 808.

In some examples, the proportion of the current flowing through Low CCT LED 806 and the proportion of the current flowing through High CCT LED 808 is based on the proportion of time that transistor Q1 is on. For example, if transistor Q1 is on 80% of the time (e.g., the duty cycle equals 80%), the proportion of the current flowing through Low CCT LED 806 equals approximately 80% of the current from secondary-side winding NS and the proportion of the current flowing through High CCT LED 808 equals approximately 20% of the current flowing through High CCT LED 808. In this example, because Low CCT LED 806 is on (emits light) and High CCT LED 808 is off (does not emit light) 80% of the time, the CCT of the light emitted by light source 805 is closer to the CCT of the light emitted by Low CCT LED 806 than the CCT of the light emitted by High CCT LED 808.

Figure 9:
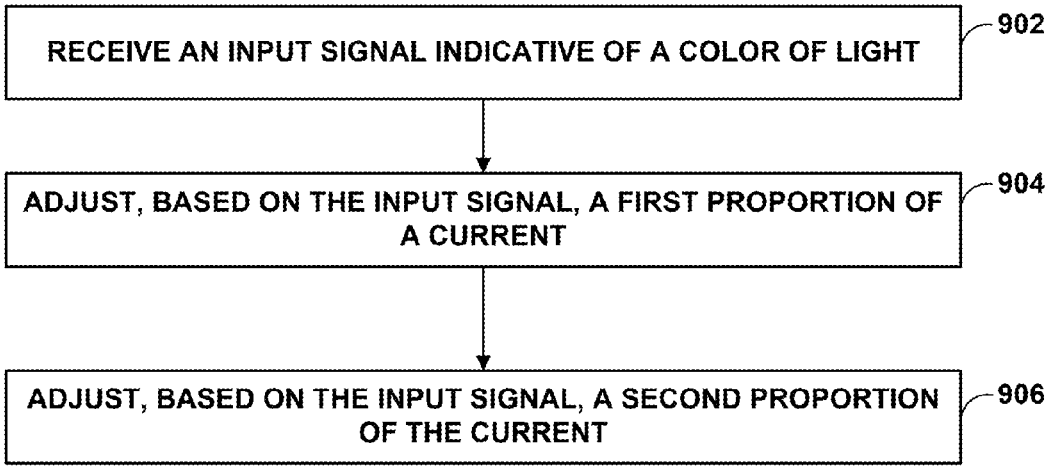
FIG. 9 is a flow chart illustrating an example method of controlling an LED based lighting system, in accordance with the examples of this disclosure.

FIG. 9 is a flow chart illustrating an example method of controlling an LED based lighting system, in accordance with the examples of this disclosure. For purposes of illustration only, the example operations are described below within the context of LED lighting system 100 as shown in FIG. 1.

A controller 104 may receive an input signal indicative of a desired color of light (902). For example, a user may adjust a physical control device (e.g., a slide actuator, rotating knob, or the like) or adjust a light setting via a computing device to indicate a desired color of light. In some examples, controller 104 includes a pulse modulation device which may receive the input signal from the physical control device or the computing device. In other examples, controller 104 may receive an input signal from a secondary side winding of a transformer.

Controller 104 may adjust, based on the input signal, a first proportion of a current, where the first proportion of the current is applied to a first LED of an LED light source 105 (904). For example, the LED light source 105 may include a Low CCT LED 106 and a High CCT LED 108. An LED driver 102 may output a current to control the brightness of the light emitted by LED light source 105. Controller 104 may control the proportion of the current output the LED driver 102 that is applied to a first LED (e.g., Low CCT LED 106) in order to control the CCT of the light emitted by light source 105. Similarly, controller 104 may adjust, based on the input signal, a second proportion of a current, where the second current is applied to the second LED of LED light source 105 (906). For example, controller 104 may control the proportion of the current output by LED driver 102 that is applied to High CCT LED 108. By controlling the proportion of the current that is applied to the first LED (e.g., Low CCT LED 106) and the proportion of the current that is applied to the second LED (e.g., High CCT LED 108), controller 104 may control the CCT of the light emitted by light source 105.

The following examples may illustrate one or more aspects of the disclosure.

Example 1

A device comprising: a light source comprising a first LED coupled to a second LED, wherein a first terminal of the first LED is coupled to a first terminal of the second LED; and a controller configured to: receive an input signal indicative of a color of light; adjust, based on the input signal, a first proportion of a current, the first proportion being applied to the first LED; and adjust, based on the input signal, a second proportion of the current, the second proportion being applied to the second LED.

Example 2

The device of example 1, wherein: the controller comprises a pulse modulation device configured to output a pulse modulated signal, wherein the controller is configured to adjust the first proportion of the current and the second proportion of the current by adjusting a duty cycle of the pulse modulated signal.

Example 3

The device of example 2, wherein: outputting the pulse modulated signal comprises alternately outputting a logical high signal and a logical low signal, a first signal of the logical high signal or the logical low signal causes the first LED to turn on and causes the second LED to turn off, and a second signal of the logical high signal or the logical low signal causes the first LED to turn off and causes the second LED to turn on.

Example 4

The device of any combination of examples 2-3, further comprising an LED driver configured to supply a current to the first LED or the second LED, wherein the LED driver is configured to control the brightness of the first LED and the second LED by adjusting the amount of the current, wherein the pulse modulation device is configured to control a color correlated temperature of a light emitted by the light source.

Example 5

The device of any combination of examples 2-4, wherein the controller further comprises a wireless transceiver coupled to the pulse modulation device, wherein the wireless transceiver is configured to: receive the input signal; and output, based on the input signal, an indication of the input signal to the pulse modulation device, wherein the pulse modulation device is configured to set the duty cycle of the pulse modulated signal based on the indication of the input signal.

Example 6

The device of any combination of examples 2-5, wherein a forward voltage drop of the first LED is approximately equal to the forward voltage drop of the second LED.

Example 7

The device of any combination of examples 2-6, further comprising: a first transistor coupled in series to a second terminal of the first LED; and a second transistor coupled in series to a second terminal of the second LED, wherein a base of the first transistor is coupled to the pulse modulation device, and wherein a base of the second transistor is coupled to either a collector or an emitter of the first transistor.

Example 8

The device of any combination of examples 2-6, further comprising: a first transistor coupled in series to a second terminal of the first LED; and a second transistor coupled in series to a second terminal of the second LED, wherein a base of the first transistor is coupled to the pulse modulation device, and wherein a base of the second transistor is coupled to the pulse modulation device.

Example 9

The device of example 1, wherein the controller comprises a transistor coupled in series to a second terminal of the first LED, wherein the controller is configured to adjust the first proportion of the current and the second proportion of the current by being configured to: generate, based on the input signal, a negative voltage; generate a transistor voltage by subtracting the negative voltage from a positive voltage; and apply the transistor voltage to the transistor, wherein the first proportion of the current and the second proportion of the current is based on the voltage level of the transistor voltage applied to the transistor.

Example 10

The device of example 9, further comprising: a dimmer and a transformer, wherein: the dimmer is located at a primary-side of the transformer and the controller is located at a secondary-side of the transformer, the current applied to a primary-side winding of the transformer is based on a voltage output by the dimmer, and the input signal comprises a current generated at a secondary-side winding of the transformer.

Example 11

The device of any combination of examples 9-10, wherein: the controller is configured to adjust the first proportion of the current by increasing the first proportion of the current when the transistor voltage is greater than a turn-on voltage of the transistor.

Example 12

The device of any combination of examples 9-11, wherein if the transistor voltage is less than a turn-on voltage of the transistor, the proportion of the current applied to the first LED equals approximately zero percent of the current and the proportion of the current applied to the second LED equals approximately one hundred percent of the current.

Example 13

The device of any combination of examples 9-12, wherein a forward voltage of the first LED is less than a forward voltage of the second LED.

Example 14

The device of any combination of examples 9-13, wherein the controller further comprises: a second transistor coupled in series to a second terminal of the second LED, wherein a base of the second transistor is coupled to either a collector or an emitter of the first transistor.

Example 15

The device of any combination of examples 1-14, wherein the first LED is associated with a first color correlated temperature and the second LED is associated with a second color correlated temperature that is different from the first color correlated temperature.

Example 16

A method of controlling a CCT of light emitted by a light source, the method comprising: receiving, by a controller, an input signal indicative of a color of light; adjusting, by the controller and based on the input signal, a first proportion of a current, the first proportion being applied to a first LED of the light source; and adjusting, by the controller and based on the input signal, a second proportion of the current, the second proportion being applied to a second LED of the light source, wherein the first terminal of the first LED is coupled to the first terminal of the second LED.

Example 17

The method of example 16, wherein the controller comprises a pulse modulation device configured to output a pulse modulated signal, and wherein adjusting the first proportion of the current and the second proportion of the current comprises adjusting, by the pulse modulation device, a duty cycle of the pulse modulated signal.

Example 18

The method of example 17, wherein the controller further comprises a wireless transceiver coupled to the pulse modulation device, the method further comprising: receiving, by the wireless transceiver, the input signal indicative of the color of light; outputting, by the wireless transceiver and based on the input signal, and indication of the input signal to the pulse modulation device; and setting, by the pulse modulation device and based on the indication of the input signal, the duty cycle of the pulse modulated signal.

Example 19

The method of any combination of examples 17-18, wherein outputting the pulse modulated signal comprises alternately outputting a logical high signal and a logical low signal, wherein a first signal of the logical high signal or the logical low signal causes the first LED to turn on and causes the second LED to turn off, and wherein a second signal of the logical high signal or the logical low signal causes the first LED to turn off and causes the second LED to turn on.

Example 20

The method of any combination of examples 17-19, further comprising supplying, by an LED driver, the current to the light source, wherein the LED driver is configured to control the brightness of the first LED and the second LED by adjusting the amount of the current, and wherein the pulse modulation device is configured to control a color correlated temperature of a light emitted by the light source.

Example 21

The method of example 16, wherein adjusting the first proportion of the current and the second proportion of the current comprises: generating, by the controller and based on the input signal indicative of the color of light, a negative voltage; generating, by the controller, a transistor voltage by subtracting the negative voltage from a positive voltage; and applying, by the controller, the transistor voltage to a transistor coupled in series to a second terminal of the first LED.

Example 22

The method of example 21, wherein adjusting the first proportion of the current includes increasing the first proportion of the current when the transistor voltage is greater than a turn-on voltage of the transistor.

Example 23

The method of any combination of examples 21-22, wherein a forward voltage of the first LED is less than a forward voltage of the second LED.

Example 24

The method of any combination of examples 16-23, wherein the first LED is associated with a first color correlated temperature and the second LED is associated with a second color correlated temperature that is different from the first color correlated temperature.

The aforementioned examples are used to show examples or applications that are applicable to the techniques and circuits described herein. In one or more examples, the functions described may be implemented in hardware, software, firmware, or any combination thereof. For example, one or more of the controllers described herein implemented in hardware, software, firmware, or any combination thereof. If implemented in software, the functions may be stored on or transmitted over, as one or more instructions or code, a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transient media, but are instead directed to non-transient, tangible storage media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperative hardware units, including one or more processors as described above, in conjunction with suitable software and/or firmware.

Various examples of the techniques of the present disclosure have been described. These and other examples are within the scope of the following claims.

The invention claimed is:

1. A device comprising:

a light source comprising a first LED coupled to a second LED, wherein a first terminal of the first LED is coupled to a first terminal of the second LED; and a controller comprising a pulse modulation device configured to output a pulse modulated signal that includes logical high signals and logical lows signals, wherein the controller is configured to:

receive an input signal indicative of a color of light;

output, via the pulse modulation device, a first logical signal of a logical high signal or logical low signal, such that the first logical signal causes the first LED to turn on and the second LED to turn off; and output, via the pulse modulation device, a second logical signal of the logical high signal or logical low signal, such that the second logical signal causes the first LED to turn off and the second LED to turn on, wherein a duty cycle of the module modulated signal is based on the input signal indicative of the color of light.

2. The device of claim 1, further comprising:

an LED driver configured to supply a current to the first LED or the second LED, wherein the LED driver is configured to control the brightness of the first LED and the second LED by adjusting the amount of the current, wherein the pulse modulation device is configured to control a color correlated temperature of a light emitted by the light source.

3. The device of claim 1, wherein the controller further comprises a wireless transceiver coupled to the pulse modulation device, wherein the wireless transceiver is configured to:

receive the input signal; and output, based on the input signal, an indication of the input signal to the pulse modulation device, wherein the pulse modulation device is configured to set the duty cycle of the pulse modulated signal based on the indication of the input signal.

4. The device of claim 1, wherein a forward voltage drop of the first LED is approximately equal to the forward voltage drop of the second LED.

5. The device of claim 1, further comprising:

a first transistor coupled in series to a second terminal of the first LED; and a second transistor coupled in series to a second terminal of the second LED, wherein a base of the first transistor is coupled to the pulse modulation device, and wherein a base of the second transistor is coupled to either a collector or an emitter of the first transistor.

6. The device of claim 1, further comprising:

a first transistor coupled in series to a second terminal of the first LED; and a second transistor coupled in series to a second terminal of the second LED, wherein a base of the first transistor is coupled to the pulse modulation device, and wherein a base of the second transistor is coupled to the pulse modulation device.

7. The device of claim 1, wherein the first LED is associated with a first color correlated temperature and the second LED is associated with a second color correlated temperature that is different from the first color correlated temperature.

8. A method of controlling a color correlated temperature of light emitted by a light source, the method comprising:

receiving, by a controller, an input signal indicative of a color of light;

outputting, by a pulse modulation device of the controller, a pulse modulated signal that includes logical high signals and logical lows signals by at least:

outputting, via a pulse modulation device of the controller a first logical signal of a logical high signal or logical low signal, such that the first logical signal causes the first LED to turn on and the second LED to turn off; and outputting, via the pulse modulation device, a second logical signal of the logical high signal or logical low signal, such that the second logical signal causes the first LED to turn off and the second LED to turn on, wherein a duty cycle of the module modulated signal is based on the input signal indicative of the color of light, and wherein a first terminal of the first LED is coupled to a first terminal of the second LED.

9. The method of claim 8, wherein the controller further comprises a wireless transceiver coupled to the pulse modulation device, the method further comprising:

receiving, by the wireless transceiver, the input signal indicative of the color of light;

outputting, by the wireless transceiver and based on the input signal, and indication of the input signal to the pulse modulation device; and setting, by the pulse modulation device and based on the indication of the input signal, the duty cycle of the pulse modulated signal.

10. A device comprising:

a light source comprising a first LED coupled to a second LED, wherein a first terminal of the first LED is coupled to a first terminal of the second LED; and a controller comprising a transistor coupled in series to a second terminal of the first LED, wherein the controller is configured to:

receive an input signal indicative of a color of light;

adjust, based on the input signal, a first proportion of a current that is applied to the first LED and a second proportion that is applied to the second LED by at least being configured to:

generate, based on the input signal, a negative voltage;

generate a transistor voltage by subtracting the negative voltage from a positive voltage; and apply the transistor voltage to the transistor, wherein the first proportion of the current and the second proportion of the current are based on the voltage level of the transistor voltage applied to the transistor.

11. The device of claim 10, further comprising a dimmer and a transformer, wherein:

the dimmer is located at a primary-side of the transformer and the controller is located at a secondary-side of the transformer, a current applied to a primary-side winding of the transformer is based on a voltage output by the dimmer, and the input signal comprises a current generated at a secondary-side winding of the transformer.

12. The device of claim 10, wherein:

the controller is configured to adjust the first proportion of the current by increasing the first proportion of the current when the transistor voltage is greater than a turn-on voltage of the transistor.

13. The device of claim 10, wherein if the transistor voltage is less than a turn-on voltage of the transistor, the first proportion of the current applied to the first LED equals approximately zero percent of the current and the second proportion of the current applied to the second LED equals approximately one hundred percent of the current.

14. The device of claim 10, wherein a forward voltage of the first LED is less than a forward voltage of the second LED.

15. The device of claim 10, wherein the controller further comprises:

a second transistor coupled in series to a second terminal of the second LED, wherein a base of the second transistor is coupled to either a collector or an emitter of the first transistor.

16. The device of claim 10, wherein the first LED is associated with a first color correlated temperature and the second LED is associated with a second color correlated temperature that is different from the first color correlated temperature.

17. A method of controlling a color correlated temperature of light emitted by a light source, the method comprising:

receiving, by a controller, an input signal indicative of a color of light;

adjusting, by the controller and based on the input signal, a first proportion of a current that is applied to a first LED of the light source and a second proportion of the current that is applied to a second LED of the light source by at least, generating, by the controller and based on the input signal indicative of the color of light, a negative voltage;

generating, by the controller, a transistor voltage by subtracting the negative voltage from a positive voltage; and applying, by the controller, the transistor voltage to a transistor coupled in series to a second terminal of the first LED, wherein a first terminal of the first LED is coupled to a first terminal of the second LED.

18. The method of claim 17, wherein adjusting the first proportion of the current includes increasing the first proportion of the current when the transistor voltage is greater than a turn-on voltage of the transistor.

* * * * *